United States Patent [19]

Weinrib

[11] Patent Number: 4,914,841

[45] **Date of Patent: * Apr. 10, 1990**

[54] DREDGING WITH A PRESSURIZED, ROTATING LIQUID STREAM

[75] Inventor: Harry P. Weinrib, Chicago, Ill.

[73] Assignee: Eddy Pump Corporation, Lincolnwood, Ill.

[ * ] Notice: The portion of the term of this patent subsequent to Jun. 24, 2003 has been disclaimed.

[21] Appl. No.: 946,582

[22] Filed: Dec. 24, 1986

[51] Int. Cl.[4] ..... E02F 3/88; F01D 1/08

[52] U.S. Cl. ..... 37/195; 37/63; 37/67; 415/53 R; 415/58.4; 415/120

[58] Field of Search ..... 37/58, 64–67, 37/61–63, 195; 415/53 R, 83, 88, 89, 213 A, 120, 213 R, 219 C, 52

[56] References Cited

U.S. PATENT DOCUMENTS 3,206,875 9/1965 Cargile, Jr. ..... 37/67

4,305,214 12/1981 Hurst ..... 37/67

4,596,511 6/1986 Weinrib ..... 415/53 R

*Primary Examiner*—Clifford D. Crowder

*Attorney, Agent, or Firm*—Fitch, Even, Tabin & Flannery

[57] ABSTRACT

An apparatus for dredging using a pump which forms a highly pressurized, rotating stream of liquid which is directed down the inlet conduit to a discharge and the momentum and energy of the rotating stream is transferred to the solids and liquids, suspending the solids to agitate and separate the same to make the solids more easily suspended. The agitated solids and liquids flow upwardly in a counter-flowing outer annular stream around the downward flowing, rotating stream. The pump is very lightweight as compared to conventional centrifugal dredging pumps and is operated at high speeds, for examble 1,000–2,000 rpm to eliminate the usual speed reducers to prevent cavitation when using the centrifugal pumps.

13 Claims, 7 Drawing Sheets

DREDGING WITH A PRESSURIZED, ROTATING LIQUID STREAM

This invention relates to a method of and an apparatus for dredging.

BACKGROUND OF THE INVENTION

Dredging is typically done with vessels, such as barges or ships which have spuds, which are driven into the water bed at one end of the vessel while a boom or ladder at the other end of the vessel extends beneath the water to the bed from which the solids are to be removed. Often, at the lower end of the ladder, there is a cutter which breaks loose the bed and forms particles for suction as suspended solids into a pipe having a suction inlet at the lower end of the ladder. The solids are pumped up the ladder by a centrifugal impeller pump and the solids are loaded onto the vessel or in some instances pumped through pipes or hoses to a location on shore for deposit. The centrifugal pumps are often located on the vessel and are driven by an internal combustion through a speed-reducer drive unit between the engine and the centrifugal impeller pump. The speed-reducer unit reduces the output speed of the engine often above 1200 r.p.m. and as high as several thousand r.p.m. to 400–600 r.p.m. which is the usual most efficient speed of such pumps. These pumps can not be driven at the higher engine speeds without cavitation. The speed-reducer units are heavy and costly.

Current centrifugal impeller pumps are very heavy users of fuel and are very heavy. By way of example, an 14-inch inlet centrifugal dredging pump may weigh in the range of 12,500 to 20,000 pounds. The weight of the pumps and their speed reducer drives severely limits the portability of small dredges to be trucked from one site to another site. Typical fuel costs for a small 10-inch centrifugal pump dredge may be about $60 per hour which is about one-half of the total operating costs per hour. The typical flow rates for an 8-inch centrifugal pump may be 100 tons per hour when dredging blue clay and the solids content flowing through the pipes and pump is often in the range of 16% to 17% by weight of blue clay solids. Thus, it will be seen that current dredging is costly in the terms of fuel expended and low in the terms of solids content being pumped. Too much water is being pumped and this is a problem if the dredged material must be trucked to a disposed site or barged out to sea. Thus, there is a need for more efficient dredging operations.

Another problem with current centrifugal pumps is that of the amount of downtime for unclogging the impellers of debris due to the fact the impeller and pump casing have narrow throats defined by portions of the impeller being located closely adjacent a pump casing surface to create the suction for pumping and that debris may be caught in this narrow space. Often, the river or harbor bottoms are full of debris including many parts of automobiles and tires as well as other refuse dumped into the water. Also, sunken logs, tree branches and other materials may become wedged in the centrifugal pump. Additionally, the impellers are exposed directly to solids which often contain sharp articles which crack or break laminated wear surfaces on the impeller or pump casing causing a rapid deterioration or de-lamination, particularly where the solids are highly abrasive sand or gravel. In any event, dredges in rivers or harbors often experience several hours of downtime per day because of impeller clogging or need of repair. The cost of small dredges may range from $125 to $300 per hour so that the amount of money lost to downtime and maintenance is significant. On very large dredges, where twenty or thirty people are on board, the downtime with no production is much more expensive.

PREFERRED EMBODIMENT OF THE DRAWINGS

Figure 1:
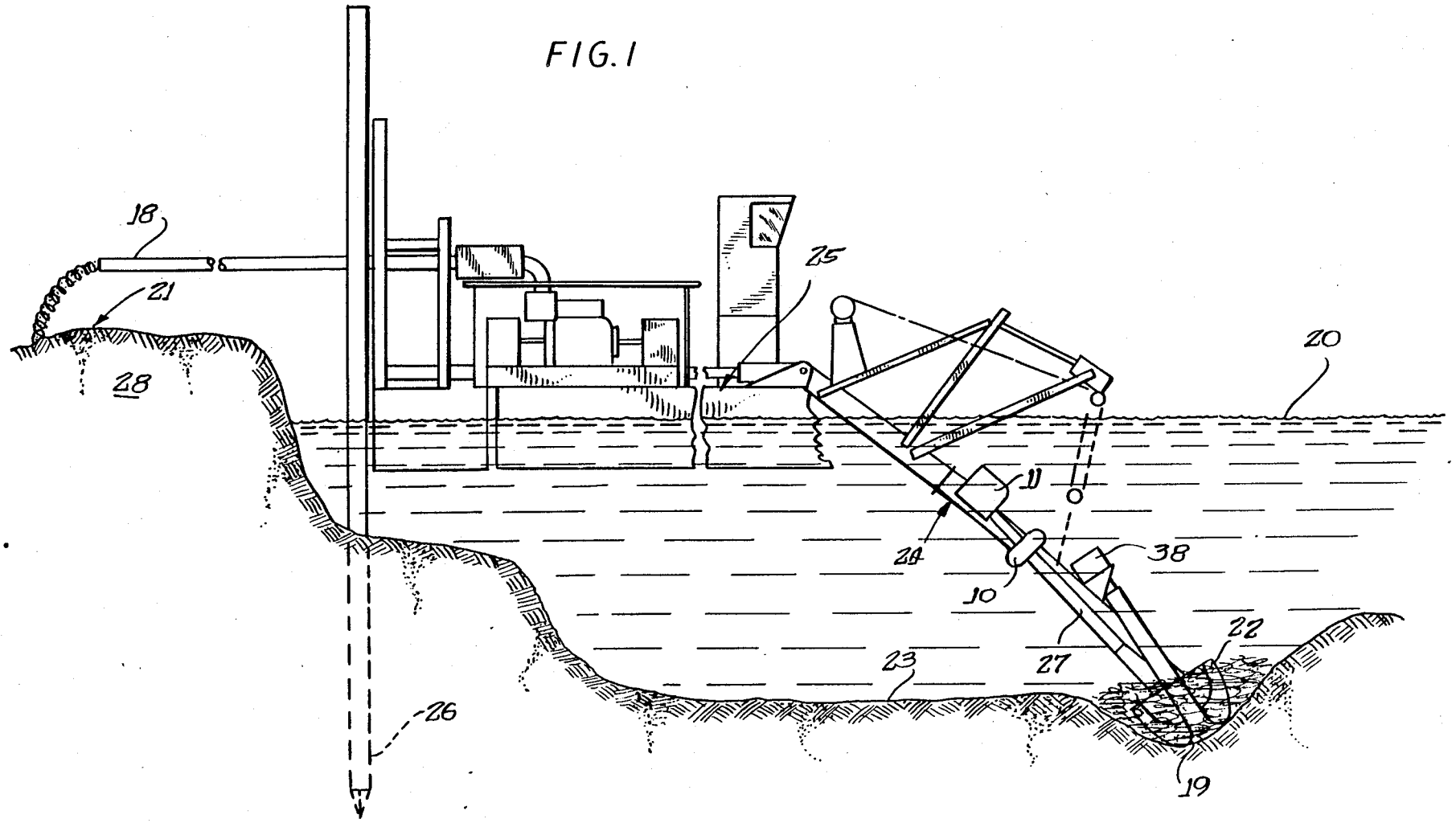
FIG. 1 is a diagrammatic view of a dredging constructed and operating in accordance with the preferred embodiment of the invention.

Accordingly, a general object of the invention is to provide a new and improved method of and apparatus for dredging.

These and other objects and advantages of the invention will become apparent from the following detailed description taken in conjunction with the accompanying drawings in which:

As shown in the drawings for purposes of illustration, the invention is embodied in a method of and an apparatus for pumping solids 16 in a traveling stream from one location 19 such as at the bottom of a body of liquid 20 such as a body of water to another second location 21. In this illustrated embodiment of the invention, the solids 16 is a dredged material from the bottom or bed 23 of the body of water and the solids usually consist of sand, gravel, clay, earth pebbles, silt, and/or man-made debris, etc. which may have to first be cut, or otherwise loosened from the bed, as by a rotatable cutter wheel 22 which is power driven by a motor 38 to break and comminute the solids on the bed 23 of the body of water. The cutter wheel 22 is mounted on the lower end of a boom or ladder 24 which extends downwardly from a support or vessel 25 herein in the form of a floating vessel which floats on the water. Often the large support 25 carries spuds 26 which are long tubular members carried by the vessel and driven into the bed 23 at the end of the vessel opposite the ladder and the cutting wheel.

Figure 2:
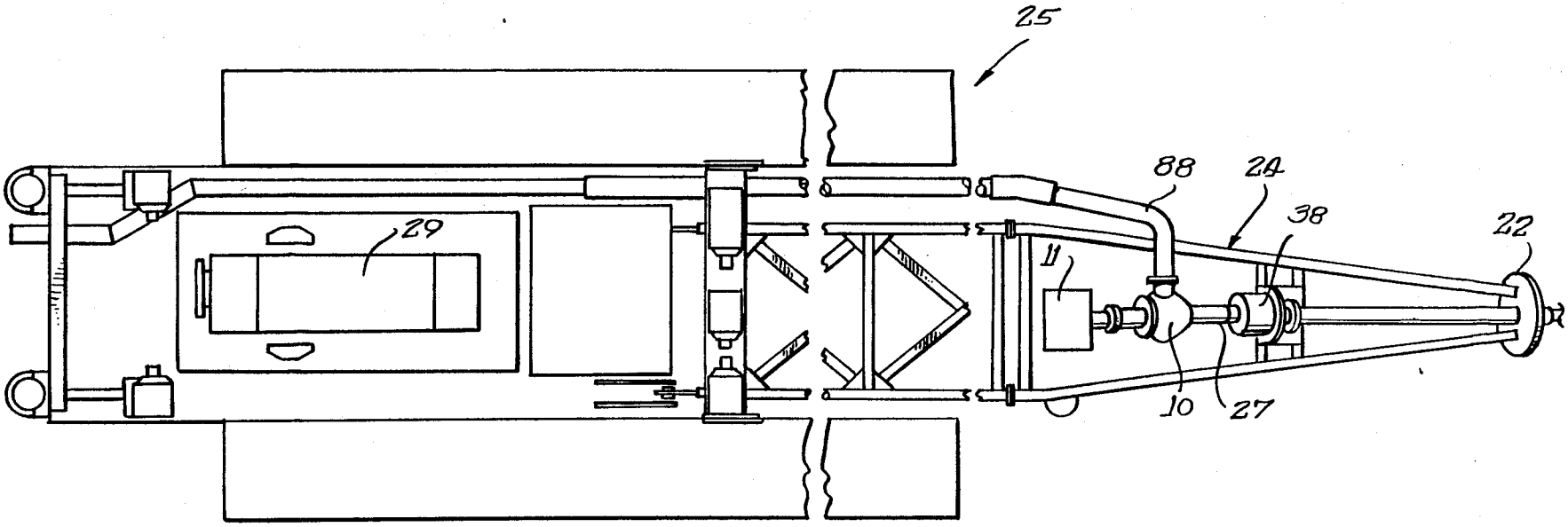
FIG. 2 is an enlarged plan view of the dredge shown in FIG. 1.
Figure 3:
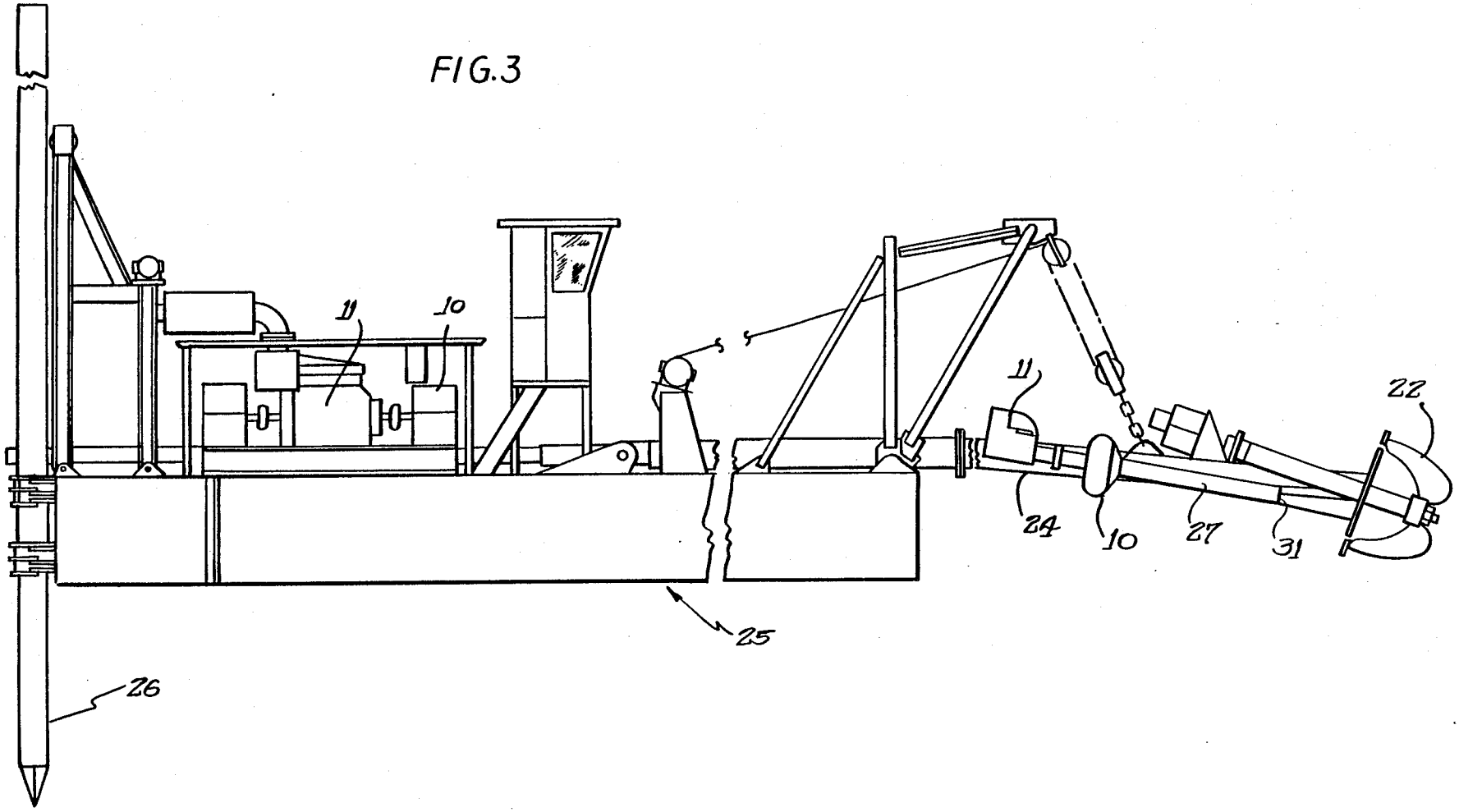
FIG. 3 is an enlarged side elevational view of the dredge FIG. 2 with the ladder in the raised position.
Figure 11:
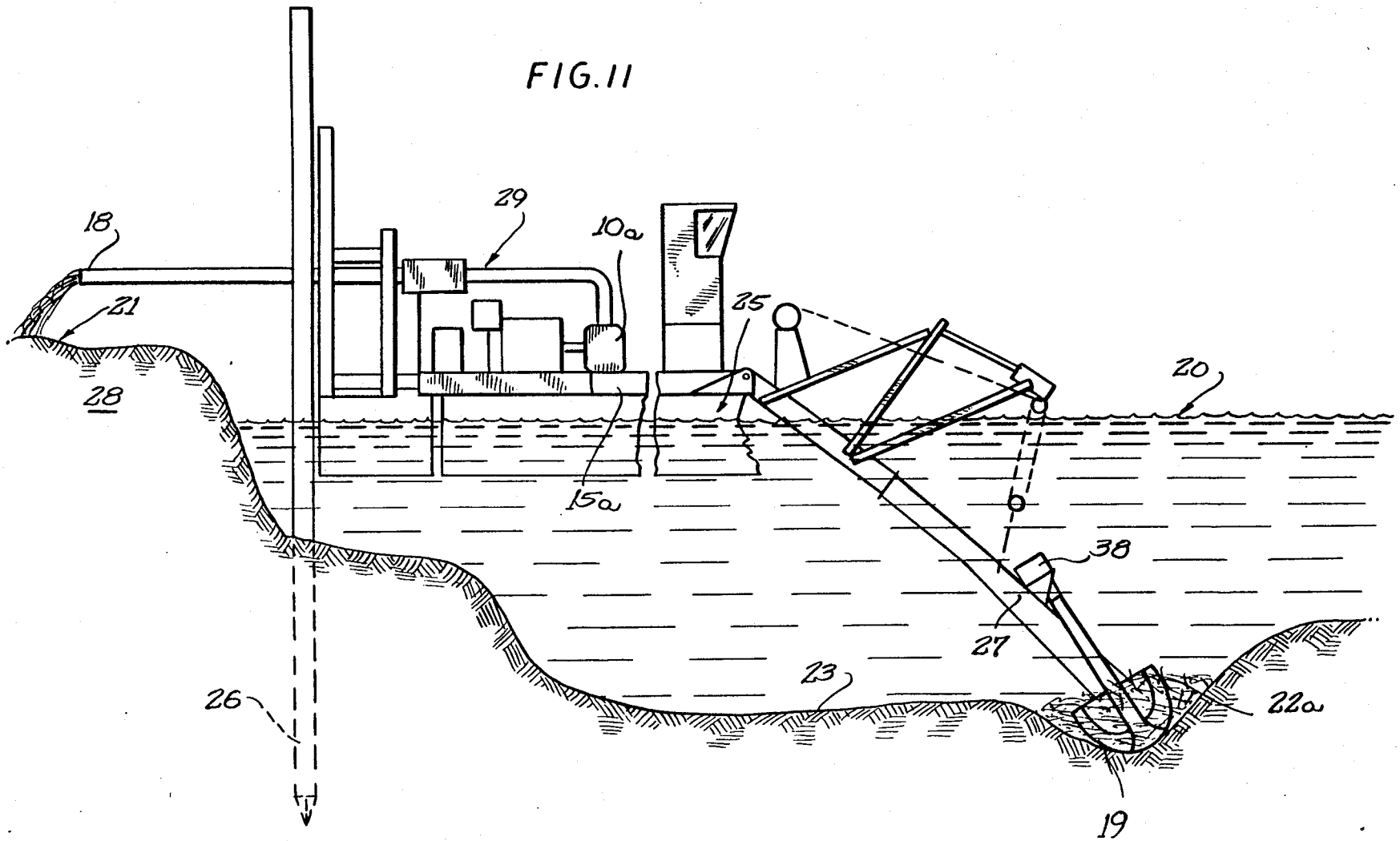
FIG. 11 illustrates a dredge constructed in accordance with another embodiment in which there is a direct drive from the diesel engine to the pump.

The solids broken loose by the cutter wheel 22 or merely lying on the bed 23 are pumped through a hose or conduit 27 having an inlet 31 located at the cutter head and the bottom of ladder 24 and conveyed upwardly either for collection on the vessel 25 or for deposition on shore 28, as illustrated herein. In some instances, the pump 10 for pumping the solids in a liquid bearing stream is carried on the vessel 25, as illustrated in FIG. 11. In other instances, the pump, as shown in FIGS. 1–3, is a submersible pump 10 mounted on the lower end of the ladder 24. In still other instances, a booster pump is used on the vessel as well as a submersible pump down on the lower end of the ladder are used.

The typical pumps used in dredging are centrifugal pumps having an impeller driven by the motor. When the centrifugal pump is large it is often mounted on the vessel adjacent the motor drive means which, in this instance, comprises an internal combustion engine 29 which is connected through a speed reducer drive (not shown) to the adjacent pump. The speed reducer device is needed because the engine typical operates at a speed in excess of 1200 r.p.m. and indeed often at 1800 to 2100 r.p.m. and the centrifugal pump can operate at a maximum speed of 600–800 r.p.m. without cavitation. At higher speeds, the centrifugal pump cavitates. Centrifugal pumps have been found to be limited also in the percentage of solids pumped. Both the gear reducers and the centrifugal pumps are very heavy and expensive pieces of equipment. Because of the wide variety of solids being conveyed the percentage of solids may vary but the percentage is said typically to be 16% to 17% by volume for a typical harbor dredging of blue clay. When dreding loose sand and gravel, the solids content may be as much as 30 to 40% solids. Dreding is also an art in that the skill of the operator controlling the dredging operation can vary the solids content or fraction being dredged by as much as 50% from an experienced, skilled operator to an inexperienced, unskilled operator. An important factor in the dredging industry is the efficiency of pumping operation since the cost of fuel for the internal combustion engine is a significant part of the cost of dredging. Often when dredging with conventional centrifugal pumps of an 8-inch inlet diameter, the flow rate may be about 100 tons per hour when dredging blue clay from a harbor bottom. Fuel costs may range from about 50% of the cost of operation for smaller dredges.

Because of the weight of the centrifugal pumps and of the gear reducer between the engine and the pump, the vessels 25 must be quite large and expensive to support this heavy weight. This weight and size of the vessel severely limits the portability by trucks of the dredging apparatus.

A problem in the use of conventional centrifugal pumps is that of clogging and the downtime for maintenance or replacement of a pump impeller. When dredging river bottoms or harbors, such parts of automobiles, tires, dumped trash, as well as naturally occurring logs, trees, organic plants, may clog the impeller necessitating a stopping of the dredging and an opening of the pump to remove the debris clogging the impeller and preventing it from rotating properly. Because dredging operations usually run 24 hours a day and seven days a week at an hour expense of $25.00 to $300.00 per hour for small dredges, the downtime can be very expensive. In situations where a large amount of debris is present, the downtime often is as much as 20% of the day on a big dredge.

In accordance with the present invention, there is provided, a new and improved manner of dredging in which the pump 10 is very lightweight compared to centrifugal dredging pumps, e.g. 500 pounds versus 10,000 pounds for pumps of similar flow rates and in which the pump 10 is operated at high speeds, for example, in excess of 1000 r.p.m. and, if desired at 1800 to 2000 r.p.m. to eliminate the expense of the speed reducer and to produce a more efficient transport of solids. This reduction in weight allows the vessel to be scaled down in size and cost and greatly increases the ability to provide a more portable vessel to be trucked from site to site. The reduction, in size and weight of the pump 10 is achieved by forming a vortex, pressurized stream of liquid within the pump and directing this stream down the inlet conduit 27 to discharge at the inlet 31 at which the momentum and energy of the traveling stream 30 is transferred to the solids and the liquid suspending the solids to agitate and separate the solids particles to make them more easily suspended because of the separation of the particles by the agitated liquid. The agitated solids and liquid flow upwardly in a counterflowing, outer annular stream 31 flowing around the downward flowing vortex stream 30.

When the bed 23 is clay, the vortex stream 30 may discharge directly at the clay bed and the energy of the stream 30 is sufficient to break loose the clay from the bed and swirl the clay into a puree of mud which then flows into the pump conduit inlet 10. The clay seems to be pulverized and homogenized to form a muddy-looking, thick viscous liquid stream discharging from the dredge. The cutter 22 need not be used in many instances with this vortex stream 30 doing the work of the cutter whereas the cutter is needed with a conventional centrifugal pump or else all one pumps is water with the conventional centrifugal pump. The power used to turn the cutter may be diverted to turn the pump and to be directed into the swirling vortex stream 30. Of course, the cutter may be used and is often necessary to break loose the bed.

In accordance with the preferred embodiment of the invention, the high pressure, rotating and downwardly traveling stream 30 discharging through the pump inlet 15 is generated within a separate chamber 46 which is separated by an apertured plate **48*a* from the pump chamber 47 so that entrained debris which tends to clog or bind the pump are not all directed against the rotating runner or impeller 35. The plate 48*a* has a central aperture 49*a* therein through which is directed a vortex discharge stream 30 of liquid discharging from the runner 35 while around the small stream is room for upward or inwardly flowing liquid to replenish the vortex chamber 46** which is being emptied of liquid.

More specifically, the vortex member runner 35 concentrates the energy being imparted to the liquid which forms the relatively slender, outwardly traveling stream 30 of liquid having a high angular velocity at a high outward velocity component which, upon reaching the orifice or inlet 31 dissipates its energy and momentum into the ambient liquid and solids 16 which swirls and agitates as shown by the directional arrows 39 in FIG. 2 to suspend and entrain the solids. The energy imparted is very significant, in that, if the solids are clay or other earthen material, the resulting mixture of earth and water is like a thin puree of mud rather large, separate chunks of clay and water as is experienced when using a conventional centrifugal pump. The entrained solids then flow more readily inwardly and upwardly about the downward flowing vortex stream 30 and forms a separate annular stream **31*a* about the vortex stream as shown by the directional arrows 37 whereas the directional arrow 39 shows that the vortex stream liquid 30 is flowing downwardly. This counter flow of liquid in opposite directions within the inlet conduit 15 gives rise to the designation of the pump as being an Eddy Pump. The upwardly traveling stream 31***a* has a high angular velocity and a high forward velocity so that the pump casing 14 is rapidly replenished with liquid for discharge from the outlet 18.

In an actual test of the dredging equipment illustrated herein, an 8-inch inlet pump 10 was provided and the pump was driven by the hydraulic motor with about 330 h.p. and a flow rate having a velocity of about 18 to 21 feet per second was observed, which is a much higher velocity than from centrifugal pumps which usually have a velocity of about 14 feet per second, or lower. The pump was driven at about 1800 to 2000 r.p.m. and the sludge material was pumped 100 feet vertically and discharged through a nozzle which was equivalent to having about 150 feet of head at the discharge. The discharging stream had a definite visible swirling rotational movement (such as shown at the discharge 18 in FIG. 1) as it fell to the water due to the rotation in a swirling manner within this unique pump. The pump had a flow rate of about 642 tons of blue clay per hour versus about 100 tons per hour for an 8-inch centrifugal dredge pump. The 8-inch pump was actually producing the output equivalent to about a 12 inch inlet pipe centrifugal pump. The discharging solids appear as a mud or puree with the blue clay from the bottom being pulverized and homogenized by the vortex stream 30 at the vortex area. The typical 14-inch pump weighs about 12,500 pounds versus a weight of less than 900 pounds for the illustrated pump 10 when the latter is made of a chromium steel or a Ni-Hard 4 steel. It was estimated that the solids contents being pumped of blue clay was about 42.5% for this invention versus the usual 10% to 17% solids obtained with a conventional centrifugal pump when dredging this blue clay. Whereas, a centrifugal pump will pump only water unless the cutter 22 is operated. It was observed that the pump 10 discharged a solids bearing stream immediately prior to driving the cutter 22 with its cutter motor 38. Also, it was noted that, on both the forward and rearward swings of the ladder that the discharge solids appeared to be about the same in percentage. This is in contrast to the conventional centrifugal pump and cutter arrangement in which the forward swing of the ladder has about 50% greater solids content flowing from the centrifugal pump than occurs on the back swing when the cutter is not nearly as effective. After shutting off the cutter 22, it was observed with this invention that "there was substantially the same solids content that was achieved on both the forward and reverse ladder swings when the horsepower being used for the cutter motor 38 was diverted to the pump motor."

Turning now in greater detail to the construction of the pump as best seen in FIG. 3, the pump 10 is constructed in accordance with the principles of the inventor's prior U.S. Pat. No. 4,596,511 and his patent application entitled "Improved Pump Construction", Ser. No. 946,307, filed of even date; this latter application discloses the pump and its operation in greater detail and this patent application is hereby incorporated by reference as if fully reproduced herein. The pump 10 comprises a pump casing 14 in which rotates an impeller or runner 35 which has a hub 36 connected to a motor shaft 12 of the motor which, in this instance, is an electric motor. Liquid flows into the bottom of pump casing 14; and, upwardly to the runner, liquid is taken through inlet openings 42 (FIGS. 4 and 6) into the vortex runner 35 from the outer peripheral region 45 of a hollow chamber 46 within the housing 14 and is directed through a plurality of passageways 48, as best seen in FIGS. 6–10 which extend and which have reducing cross-sectional areas so that the liquid is accelerated as it travels generally radially inwardly to a vortex forming means or tube 50. More specifically, a plurality of passageways 48, there being four in the illustrated embodiment of the invention, each provide an accelerating stream of liquid to a hollow interior 51 of the vortex tube at discharge surfaces 52 which are located tangentially to the interior wall of the tube so that each liquid stream is given a swirling action as it enters the tube. Because the top of the tube is closed, the combined streams of liquid form the downwardly and swirling stream 30 which rotates about the axis 40 of the runner and discharges as the vortex stream 30 at the end of the inlet conduit 15.

Referring now in greater detail to the embodiment of the invention, the pump casing 14 shown in FIGS. 4–10 is formed with a cylindrical metal wall 55 which is coaxial with the vertical axis 40 which extends through the runner drive shaft 12 and through the pump inlet conduit 15. The casing 14 includes a top circular plate 57 which has a sealed connection to a motor flange 58 on the motor 11. Herein, the pressure within the vortex chamber 46 is not very low and no elaborate seal system is needed. The particular manner of mounting the shaft and bearing are herein illustrated as being on the external side of the top plate 57 of the housing. The casing includes a lower cylindrical or bowl-shaped half 59.

The pump inlet conduit 15 is preferable in the form of a metal flared pipe which is secured to the bottom wall of the casing half 59 in the center thereof. The pump inlet conduit includes the elongated hose or pipe 15 extending from the pump housing to the inlet 31 which is located closely adjacent the cutter 22. It is to be understood that the casing 14 and inlet conduit 15 may take many shapes and that the bowl or cylindrical shapes as shown herein are merely illustrative and are not by way of limitation of the claimed subject matter.

Figure 6:
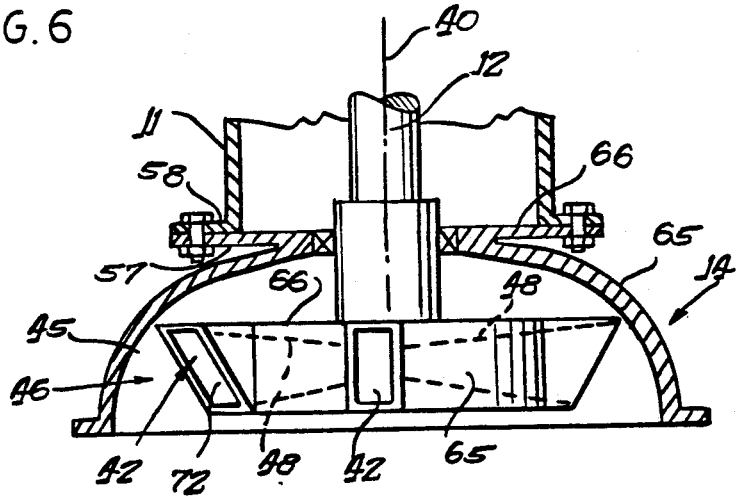
FIG. 6 is an enlarged cross sectional view taken through the pump.
Figure 7:
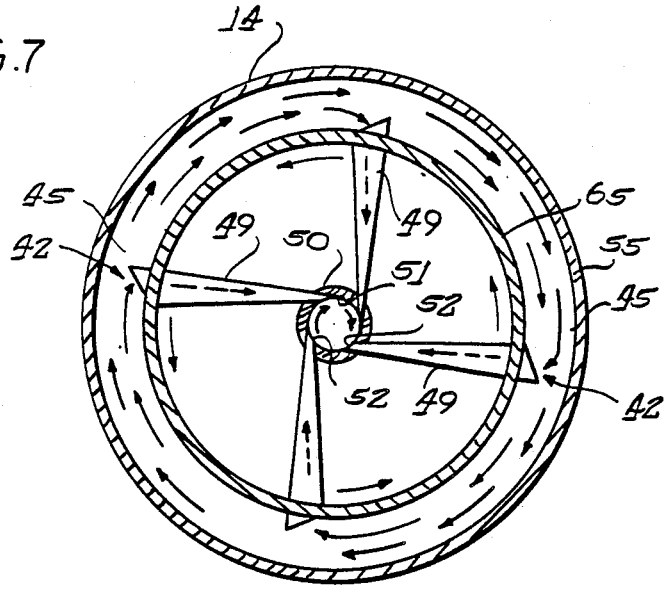
FIG. 7 is an enlarged sectional view showing the runner and upper housing portion.

The preferred and illustrated vortex generating member 35 shown in FIGS. 4–10 comprises a generally hollow conical shell having an outer conical wall 65 covered at the top by an upper circular horizontally extending top plate 66. The latter is mounted on the lower end of the driving shaft 12 by the hub 36, as best seen in FIG. 6. It is preferred to space the peripheral edge 70 of the upper plate 66 of the vortex forming member at a considerably distance from the casing side wall 55 to alleviate the chance of jamming or otherwise binding the rotating runner 35 by solids or debris wedging or compacting between the runner and the casing wall. Preferably, the inlet ends 42 to the passageways 48 are formed in the manner of scoops with an inclined forward wall 72 (FIGS. 6, 7) with the scoops rotating in the counterclockwise direction shown in FIG. 7 to scoop in liquid through the inlets 42. Each of the inlets 42, is at the same radial distance from the central pump axis 40; and each passageway 48 provides the same flow path between its inlet 42 and the vortex tube 50 so that the particles of liquid entering each one of the four inlets 42 at the same vertical height in the pump casing undergo the same length of travel and undergo the same acceleration in their travel to the vortex tube and should likewise enter the vortex tube at the same substantially tangential angle to the interior wall 51 of the tube 50 as illustrated in FIG. 7. It will be appreciated that the angle of the passageways 48 to the vortex tube may be changed from tangential to another angle and still form the vortex and fall within the purview of the present invention.

Figure 8:
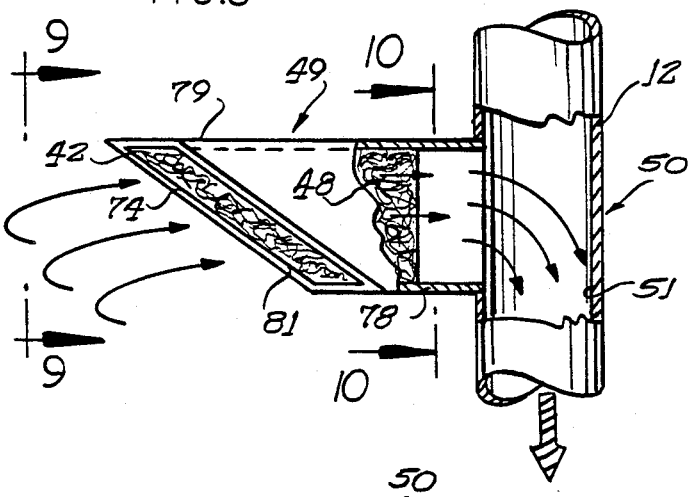
FIG. 8 is a partially sectioned, fragmentary view of the runner and showing the flow of material to the central axis of rotation of the runner.
Figure 9:
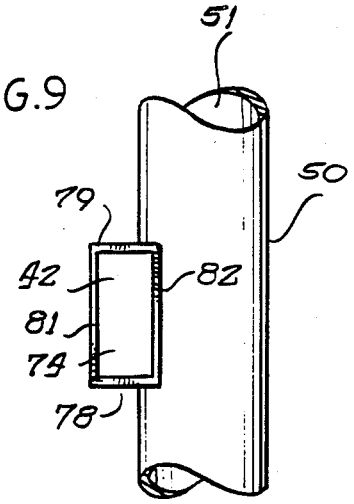
FIG. 9 is a view taken along the line 9—9 of FIG. 8 showing the cross-sectional area of a runner.
Figure 10:
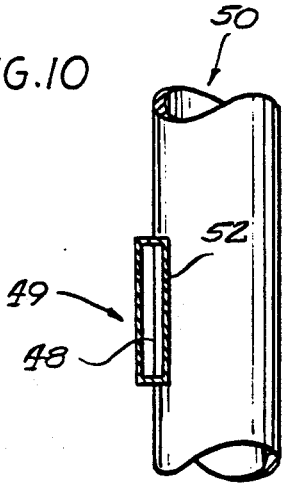
FIG. 10 is a further cross-sectional view taken along a line close to the central axis and through the runner vane.

The illustrated passageways 48 are each formed in a metal tubular channel 49 of parallelepiped shape having four walls. More specifically, the channels 49 have parallel upper and lower walls 78 and 79 which extend generally horizontal in their direction from the vortex forming tube 50 as best seen in FIG. 8. The upper and lower walls 78 and 79 are joined to vertical channel side walls 81 and 82 which are inclined towards one another from the inlets 42 to their inner discharge outlets or orifices 52 at the vortex forming tube 50. Herein, the side walls 81 and 82 are straight, but in other instances they could be curved. As best seen between the comparison of FIGS. 9 and 10, the cross sectional area at the inlet 42 is about four times larger than the area at discharge orifice 52, as shown in FIG. 10. It will also be appreciated as shown in FIG. 8 that the inlets 42 extend and are generally tapered to be similar to the taper of the conical shell surface 65 from which they project.

From the above, it will be seen that in the preferred embodiment of the invention, liquid in the vortex chamber 46 will be flowing through the inlets 42 whereas the liquid in the pumping chamber will be principally flowing about the vortex column to discharge out the opening 87 (FIG. 4) in the cylindrical side wall 55 to which are attached the discharge pipe or hose 88. The number of discharges may be only one, or a greater number depending upon the end use of the pump. Of course, some liquid in the pumping chamber is flowing upwardly about the tube 50 and through the aperture 49*a* in the plate 48*a;* and the liquid stream 30 discharging from the tube 50 flows downwardly at the center of the pumping chamber into and through the pump inlet conduit 15 to discharge in the ambient liquid.

Figure 4:
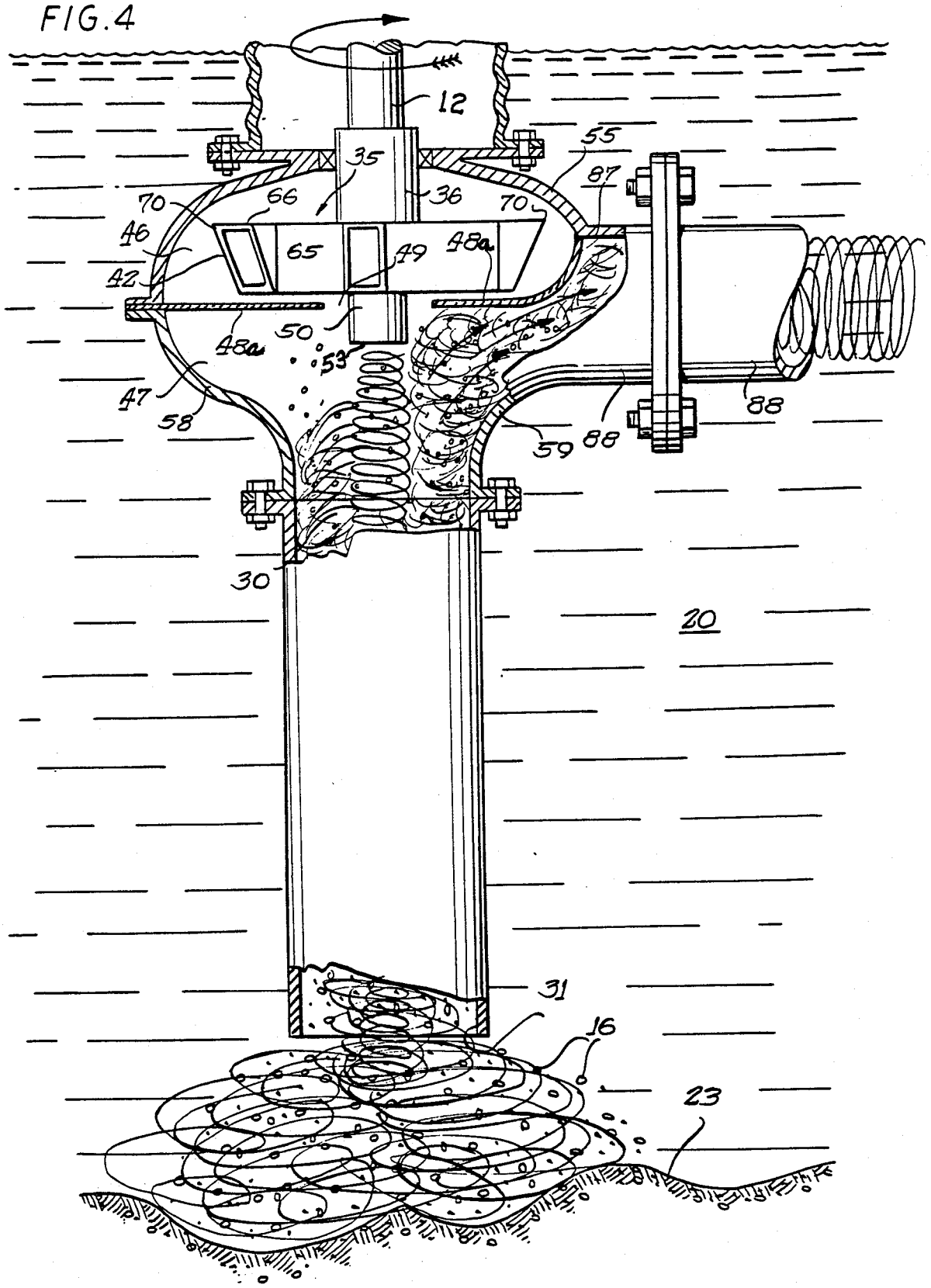
FIG. 4. is a diagrammatic illustration of the pump discharging and breaking loose the bed to be dredged.
Figure 5:
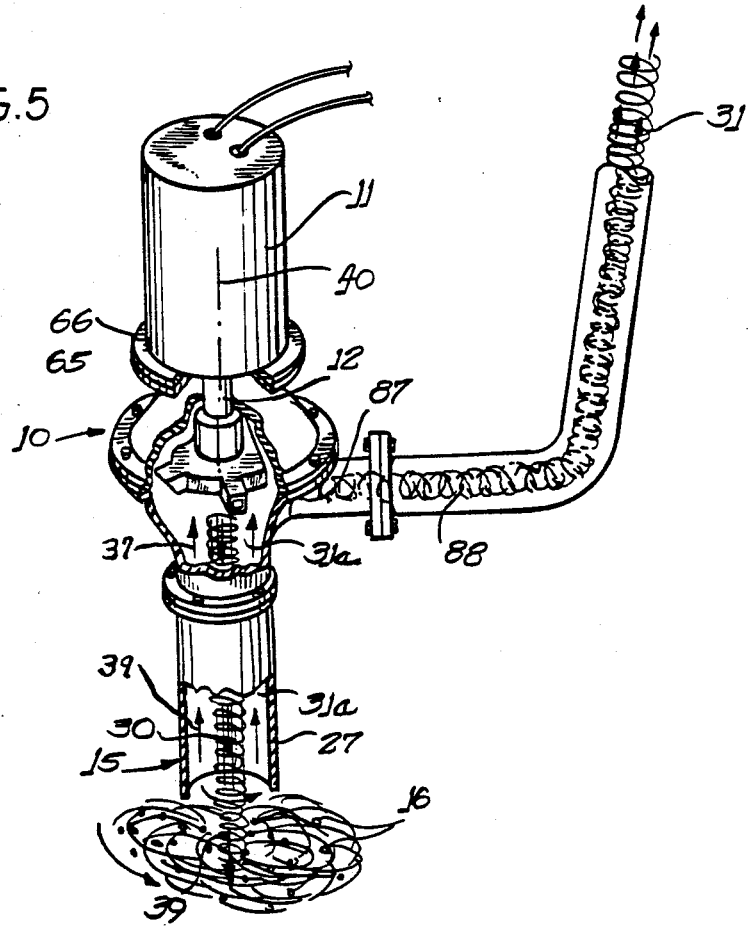
FIG. 5 is a diagrammatic illustration of the pump used in the invention.

The vortex tube 50 for forming the vortex initially, and to discharge the same from the rotating member 35 is preferably in the form of a cylindrical metal tube which has been perforated in a vertical direction at four circumferentially, equally spaced locations and to which are welded or otherwise secured the inner ends of the passageway channels 49. As best seen in FIG. 4, the vortex tube 50 extends beneath the lower end of the divider plate 48*a* to its discharge end 53 which may be spaced a short distance below the divider plate 48. The distance that the vortex tube extends downwardly may be increased or decreased from that illustrated herein. Herein, the vortex tube 50 is centered in the aperture in the divider plate 48*a* and on the axis 40, and the vortex tube discharges the small diameter stream 30 of liquid through the center of the aperture 49*a* while other liquid flows about the vortex stream 30 and into the vortex chamber 46. Also, the preferred vortex forming means, or tube 50, may be changed considerably in shape and in structure from that shown herein and still fall within the purview of the present invention.

In the embodiment of the invention shown in FIG. 11, the elements above-described are identified by the same reference characters with a suffix "a". Herein, the pump 10*a* is mounted on the vessel above the water level and the pump is connected by an inlet conduit 15*a* which extends to the ladder and down the ladder to an inlet opening adjacent the cutter wheel 22*a*. The pump 10*a* is directly driven by a diesel motor at speeds in the range of 1800 to 2000 r.p.m. which is far in excess of the usual 600 to 800 r.p.m. maximum speed for the typical centrifugal impeller pump. Hence, the usual speed reducer between the pump and the diesel motor may be eliminated.

From the foregoing, it will be seen that rather than having closely-fitted members and casings or housings, as in the conventional centrifugal pump, the present invention uses the formation of pressurized, traveling and rotating stream 30 which is a highly rotational, narrow, almost cylindrical band of sludge which tapers and spreads slightly in the downward direction within the inlet tube until exiting the same at which time all of the energy concentrated into the vortex stream is released into the ambient pool of liquid to form an area of low pressure. If the pump inlet orifice 31 is located closely adjacent the bed, then the vortex stream may dislodge and pulverize the solids and form a homogeneous stream. If the material being pumped is a thixotropic fluid, the vortex stream imparts energy and swirling motion to the fluid and reduces its viscosity for flowing more easily into the pump casing.

Various structures have been illustrated herein, other improved embodiments may use various other forms of structure and still fall within the purview of the present invention. For instance, it is contemplated that improved results may be obtained by forming the passageways 48 in a convolute shape with a large outer diameter to cause the liquid to spiral downwardly and inwardly through a tapered, reducing cross section to accelerate the liquid continuously in not only a radial but also in a downward direction until it enters the vortex tube.

The preferred vortex generator is disclosed in a U.S. patent application filed by this inventor on even date and entitled "Improved Pump Construction" and the vortex generator disclosed therein has four identical blades extending at 90° from each other and from a common hub.

By way of analogy only, the swirling column of liquid could be considered to be a whirlpool but flowing downwardly. On the other hand, if the inlet pipe 15 were submerged and upstanding from the casing, the liquid vortex column would be travling upwardly as in a whirlpool. In tornadoes or whirlpools, the high angular velocity flow is known to create very great suction to pull material inwardly to the vortex and to be lifted thereby. It is thought that the present invention may be analogous to such naturally occurring phenomena.

What is claimed is:

1. A method of dredging with a pump comprising the steps of:

creating a pressurized traveling stream of liquid within a pump casing, directing the pressurized traveling stream of liquid through the pump inlet and dissipating the traveling stream into the pool of liquid around the inlet, flowing a liquid stream bearing solids into the inlet and about the pressurized traveling stream and in a direction counter to the direction of the pressurized traveling stream, directing the solid bearing stream of liquid into the pump casing, and discharging the solid bearing stream of liquid from the pump casing.

2. A method in accordance with claim 1 in which said pump has a rotating runner and said method includes the step of rotating the runner at a speed in excess of 1000 rpm to create the pressurized traveling stream flow from the pump inlet.

3. A method in accordance with claim 1 including the step of directing the discharging liquid stream of liquid and solid through a discharge conduit in a helical swirling flow.

4. A method in accordance with claim 1 including the step of forming a solid bearing stream having at least 45% solids by volume at the discharge from the pump casing.

5. A method of dredging with a pump comprising the steps of:

creating a pressurized traveling stream of liquid within a pump casing, directing the pressurized traveling stream of liquid through the pump inlet and directing the traveling stream against a body of solids, agitating the solids and separating the solids to form a vortex stream of liquid and solids, flowing a liquid stream bearing solids into the inlet and about the pressurized traveling stream and in a direction counter to the direction of the pressurized traveling stream, directing the solid bearing stream of liquid into the pump casing, and discharging the solid bearing stream of liquid from the pump casing.

6. A method in accordance with claim 5 including the step comminuting a solid bed of earth into a puree-like stream of water and earth particles.

7. A method in accordance with claim 6 including the step of rotating the solid bearing stream through a discharge pipe from the pump casing.

8. A method in accordance with claim 5 including the step of directing the vortex discharging stream from the pump inlet substantially vertically against the solids on the bottom of the body of water.

9. A method in accordance with claim 8 including the step of directing the vortex discharging stream of liquid adjacent a cutter and rotating the cutter to cut solids for being swirled by the vortex discharging stream.

10. A method of dredging comprising the steps of:

creating a rotating stream of liquid within a pump casing traveling at a high speed and with momentum, discharging the rotating high speed stream of liquid from the inlet to the pump into the solids to be dredged to impart energy to the solids to disperse and separate the solids for carrying by the liquid, forming an area of low pressure at the inlet, traveling a vortex stream of liquid bearing dredged solids upwardly through the inlet, and rotating the upwardly traveling vortex stream in an annular path about the downwardly traveling high speed stream, and discharging the solids bearing stream from the pump casing.

11. A method in accordance with claim 10 for dredging in which said motor drive means comprises a submersible motor mounted on said boom for driving said pump.

12. A method in accordance with claim 11 for dredging in which said submersible motor is a hydraulic motor.

13. A method of dredging comprising the steps of:

creating a rotating stream of liquid within a pump casing traveling at a high speed and with momentum, discharging the rotating high speed stream of liquid from the inlet to the pump into the solids to be dredged to impart energy to the solids to disperse and separate the solids for carrying by the liquid and forming an area of low pressure at the inlet, traveling a stream of liquid bearing dredged solids upwardly through the inlet and rotating the stream in an annular path about the stream traveling downwardly toward the inlet, and discharging the solids bearing stream from the pump casing.

* * * * *